United States Patent [19]

Tirp et al.

[11] Patent Number: 4,917,661

[45] Date of Patent: Apr. 17, 1990

[54] DEVICE FOR COLLECTING BAGS OR SACKS

[75] Inventors: Erwin Tirp, Lengerich; Heinz Peters, Lienen, both of Fed. Rep. of Germany

[73] Assignee: Windmoller & Holscher, Lengerich, Fed. Rep. of Germany

[21] Appl. No.: 210,338

[22] Filed: Jun. 23, 1988

[30] Foreign Application Priority Data

Jul. 30, 1987 [DE] Fed. Rep. of Germany ..... 3725335
Feb. 29, 1988 [DE] Fed. Rep. of Germany ..... 3806445

[51] Int. Cl.[4] ..... B65H 29/00
[52] U.S. Cl. ..... 493/194; 493/204
[58] Field of Search ..... 493/194, 199, 203, 204; 156/515; 271/175; 414/97

[56] References Cited

U.S. PATENT DOCUMENTS

| | | | |
|---|---|---|---|
| 2,571,941 | 10/1951 | Piper et al. | 271/175 |
| 2,925,119 | 2/1960 | Jaquiery | 493/204 |
| 4,170,927 | 10/1979 | van der Meulen | 156/515 |
| 4,624,615 | 11/1986 | Russell et al. | 271/175 |
| 4,778,438 | 10/1988 | Tastavin et al. | 271/175 |

*Primary Examiner*—Frederick R. Schmidt
*Assistant Examiner*—Jack W. Lavinder
*Attorney, Agent, or Firm*—Fleit, Jacobson, Cohn, Price, Holman & Stern

[57] ABSTRACT

A device for collecting bags or sacks in a machine for making the bags or sacks is in the form of a receiving rod which is mounted in the machine frame and extends transversely to the direction in which the bags or sacks to be deposited are advanced or conveyed so that, in use, the bags or sacks are draped over the rod.

3 Claims, 3 Drawing Sheets

DEVICE FOR COLLECTING BAGS OR SACKS

BACKGROUND OF THE INVENTION

1. Field of the Invention

This invention relates to a device for collecting bags or sacks delivered by a machine for making the bags or sacks.

2. Description of Prior Art

Known collecting means comprise collecting decks or collecting belts on which bags or sacks which are cyclically made are superimposed to form stacks having a predetermined height. The stacks are subsequently removed and carried away. The provision of collecting decks or so-called collecting belts, however, is relatively expensive and adds to the costs of machines for making sacks or bags.

SUMMARY OF THE INVENTION

It is an object of the invention to provide a device of the kind described which is simple in structure and can be made and installed in an economical manner.

In an apparatus of the kind concerned, the object is accomplished in accordance with the invention in that the collecting device comprises a collecting rod which is mounted in the machine frame and extends transversely to the direction in which the bags or sacks to be deposited are advanced or conveyed so that, in use, the bags or sacks are draped over the rod.

The device in accordance with the invention comprises a collecting member which may consist only of a simple rod, on which the bags or sacks are superimposed in such manner that the rod is disposed approximately at the center of the bags or sacks. As a result, the superimposed bags or sacks which have been delivered in succession are collected in such a manner that they are laid approximately in the form of loops, preferably of U-shaped loops, over the collecting rod until a stack containing a desired number of the bags or sacks has been formed. The stack can then be removed by hand or in a different manner. A collecting member consisting only of a transverse rod can be made and installed in a simple manner.

In accordance with a further development, the invention relates to a device of the kind described and known, e.g., from German Patent Specification No. 28 33 236, the corresponding U.S. Pat. No. 4,235,659, and the corresponding Japanese Patent Application No. 97,189/79. That device comprises retaining means, which directly succeed a transverse welding and transverse severing device of the machine for making sacks or bags and which serve to retain the superimposed bags or sacks and to release them when a stack has been formed. In accordance with the invention, a collecting rod is guided in the machine frame so as to be transversely displaceable and/or is adapted to be fixed in position so that the collecting rod is adapted to be fixed in the middle region of the stacks of bags or sacks being formed. In this embodiment of the invention, the sacks or bags are pushed over and beyond the collecting rod in such a manner that those portions of the sacks or bags which extend beyond the collecting rod are deflected to depend from the rod. When the completed stack is removed from the retaining device so that the rear portion of the stack is also released, the rear portion will depend also, and the complete stack lying on the collecting rod is then shaped like a hairpin and can be removed in that shape from the rod. Before the complete stack of sacks or bags is removed, the formation of the next succeeding stack can be initiated because the stacks will effectively be separated as the stack which is being formed is held at its rear edge by the retaining means.

The stacking means in accordance with the invention is particularly suitable for a stacking of sacks or bags which are made of plastic because they are so flexible that they can be deposited exactly in loop form on the receiving rod.

In a preferred arrangement, the collecting rod is connected at least at one end to a carrier extending at right angles to the rod. The carrier is pivoted in the machine frame on an axis parallel to the collecting rod, and the carrier is adapted to be fixed in different angular positions. Due to the pivotal mounting of the collecting rod, the latter can be adjusted in a simple manner for different lengths of sacks or bags. For example, if the collecting rod is mounted in the machine frame by only one carrier, so that a gallows-like structure is provided, the collecting rod will protrude freely so that the stacks which have been formed can be removed in a simple manner and without an obstruction by a second carrier.

In a suitable arrangement, the carrier is mounted in its pivotal mounting for longitudinal displacement and is adapted to be fixed in position therein so that the difference in elevation which is due to the pivotal movement can be compensated in a simple manner.

The carrier may be longitudinally slidably mounted in a slide bushing or the like which is spaced above the pivotal axis of the carrier, the carrier may be adapted to be fixed in position relative to the slide bushing, and the slide bushing may be guided on a transversely extending track and may be adapted to be fixed in position.

DETAILED DESCRIPTION OF PREFERRED EMBODIMENT

An illustrative embodiment of the invention will now be explained in detail with reference to the drawings.

Figure 1:
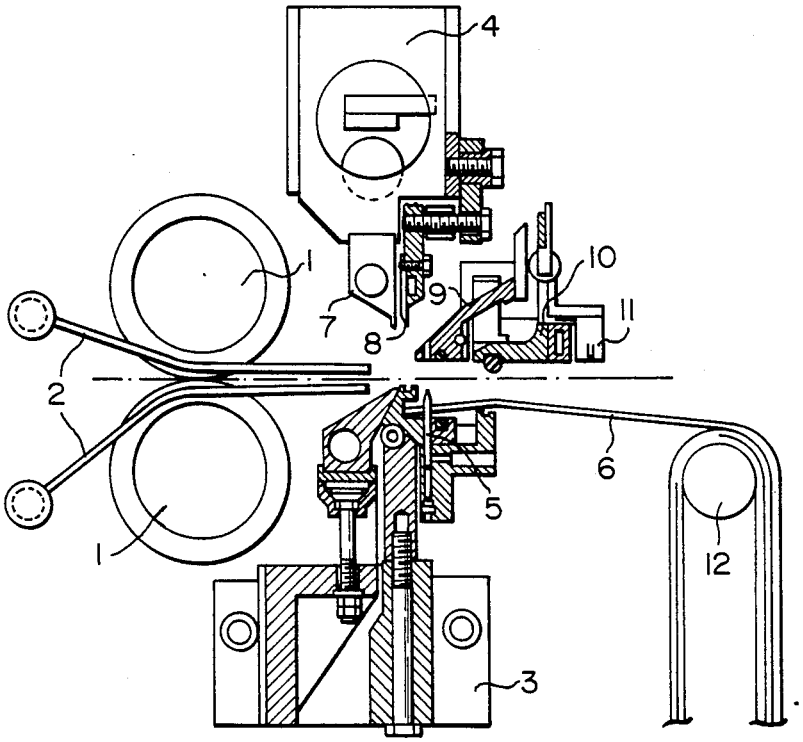
FIG. 1 is a part-sectional side elevation showing a transverse welding device for severing bags or sacks from a continuous tubular plastic film and for welding the bags or sacks, and a collecting rod succeeding the welding device.

A continuous tubular film (FIG. 1) is advanced by a pair of pinch rollers 1, which are formed with annular grooves, in which rakes 2 consisting of air-blasting tubes are disposed in the manner shown. The rake-like air-blasting tubes 2 are succeeded in the direction of travel by a welding device comprising a stationary lower part 3 and a movable upper part 4. The lower part of the welding device has associated with it a needle bar 5, which is movable up and down and on which sacks 6 formed from the film, and which are to be stacked, are needled at their trailing end portions. The movable upper part of the welding device consists of a welding jaw 7, a severing knife 8, a needle bar 9, a clamping jaw 10, and means 11 for removing any static electric charges from the sacks to be stacked. The sack-making machine described thus far is known, for example, from German Patent Specification No. 28 33 236, and the corresponding foreign patents mentioned above and the disclosure thereof is incorporated herein by reference as far as details are concerned.

In the direction of travel of the continuous tubular film from which the sacks 6 to be welded are severed, the row of needles 5 are succeeded by a collecting rod 12, which is secured to the machine frame and on which each bag 6 is deposited.

Figure 2:
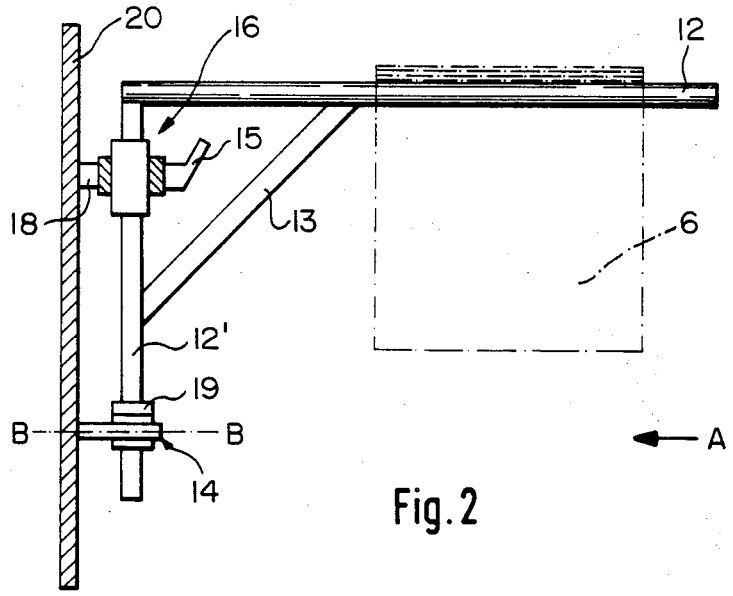
FIG. 2 is a front elevation of the collecting rod and its mounting.
Figure 3:
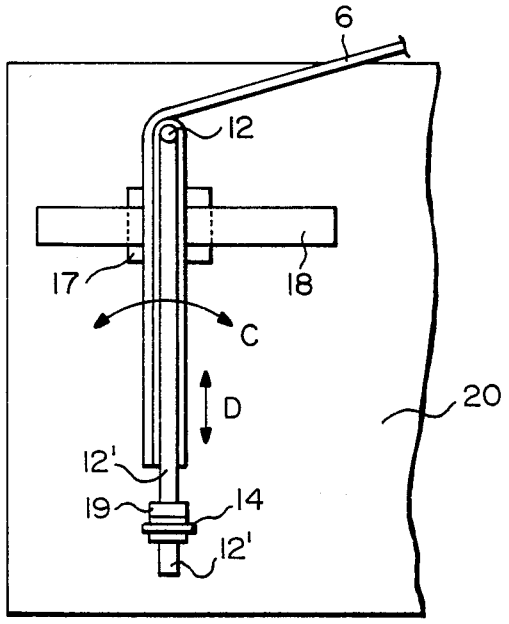
FIG. 3 is a side elevation of the collecting rod viewed in the direction of the arrow A in FIG. 2.

As is apparent from FIGS. 2 and 3, the collecting rod 12 is fixedly connected to a carrying tube 12', constituting a carrier, which extends at right angles to the rod 12 and is mounted for pivotal movement in a vertical plane which is parallel to the direction of travel. The collecting rod 12 is stabilized by an inclined strut 13 that is connected to the rod 12 and to the carrying tube 12'.

Figure 4:
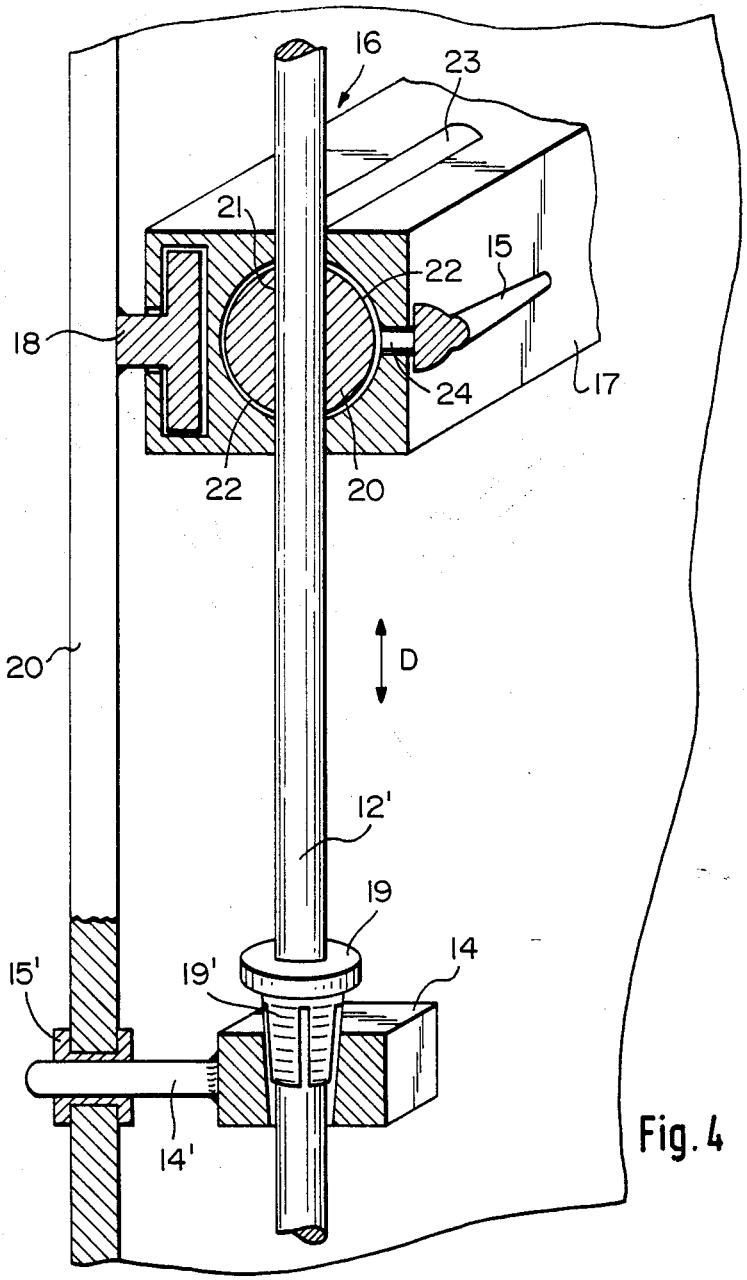
FIG. 4 is a perspective view, part broken away, of the collecting rod mounting.

The carrying tube 12' and the collecting rod 12 carried by the tube constitute a structure which resembles a gallows. The carrying tube 12' is pivotally movable in the direction of the arrow C about the axis B—B of a lower pivotal mounting 14. The mounting 14 consists of a block to which a pin 14' is welded. As is apparent from FIG. 4, the pin 14' is pivotally mounted in a bearing 15' in the side wall 20. The block 14 is formed with a slightly tapering bore that is formed with screw threads for interengaging with external screw threads formed on a longitudinal slotted tube 19' which is provided at its top with a handle disc 19. The carrying tube 12' slidably extends through the slotted tube which is screwed into the tapered screw threads in block 14. The tongues which are defined by the longitudinal slots of the slotted tube clamp the carrying tube 12' in position. When the slotted tube has been loosened, the carrying tube 12' can be displaced in the block 14.

Above the mounting 14, the side wall 20 is provided with a horizontal track rail 18, which is T-shaped in cross-section and on which a slide block 17 is slidably mounted. A spherical bearing a ball 20 having a central bore 21 is movably mounted in mating hemispherical recesses 22 of the slide block. The carrying tube 12' extends through the bore of the ball. In a manner that is not shown, the slide block consists of two parts to permit a movable mounting of the ball. The carrying tube 12' extends through the slide block 17 in longitudinal slots 23, which are parallel to the side wall 20. A clamp screw 24 provided with a handle 15 is screwed into a tapped bore of the slide block 17 and may be used to clamp the ball in the associated mounting socket and thereby also clamp the slide block in position on rail 18, because the slide block cannot move along the rail unless the ball is free to swivel in recesses 22.

To permit a change of the distance from the collecting rod 12 to the welding device 3, 4 by a pivotal movement of the carrying tube 12', the clamp screw 15 may be loosened. After the desired pivotal adjustment, the clamp screw 15 is tightened to fix the carrying tube 12' in a selected angular position.

In order to ensure that the collecting rod 12 will be in a given elevation regardless of the angular position which has been adjusted, the handle 19 may be operated to release the slotted clamping tube 19. This will be effected after each pivotal movement, e.g., after a change in bag size. When the slotted tube has been released, the carrying tube 12' can be adjusted in height in the direction of the arrow D to the correct elevation. When the elevation has been adjusted, the hand wheel 19 is operated to screw the slotted tube back into the tapered screw threads of the pivotal mounting block 14. The position of the collecting rod can thus be adjusted both vertically and angularly to suit different bag dimensions and the like. The provision of pin 14', ball 20, and slots 23 allows the block 17 to slide along rail 18 to adjust the inclination of the tube 12' and thus the distance of rod 12 from the welding jaws.

I claim:

1. A device for collecting bags or sacks in a machine for making the bags or sacks, wherein the collecting device comprises a collecting rod, which is mounted in a frame of the machine and which extends transversely to a direction in which the bags or sacks are advanced through the machine, wherein the collecting rod is connected at one end to a carrier extending at right angles to the rod, said carrier being pivoted in the machine frame about a pivot axis parallel to the collecting rod, and the device including means for fixing the carrier in selected positions, characterized in that the carrier is longitudinally slidably mounted in a slide means, which is spaced above the pivot axis of the carrier, the carrier being adapted to be fixed in position relative to said slide means, the slide means being mounted for movement along a transversely extending track and having means for fixing same in position on the track.

2. A device according to claim 1, wherein the carrier is a tube which extends through a spherical bearing in the slide means.

3. A device according to claim 2, wherein a lower end of the tube is mounted in a block carrying a transverse pivot pin defining the pivot axis, the block having an adjustment nut with a tapered thread inserted therein and surrounding the tube for adjustably fixing the tube lengthwise in the block.

* * * * *